US008328599B2

(12) United States Patent
Yang

(10) Patent No.: US 8,328,599 B2
(45) Date of Patent: Dec. 11, 2012

(54) INTERNAL ROTATION TYPE DIRECT MOTOR-DRIVE PORTABLE ANGLE GRINDER

(76) Inventor: Tai-Her Yang, Dzan-Hwa (TW)

( * ) Notice: Subject to any disclaimer, the term of this patent is extended or adjusted under 35 U.S.C. 154(b) by 526 days.

(21) Appl. No.: 12/573,208

(22) Filed: Oct. 5, 2009

(65) Prior Publication Data

US 2011/0081846 A1 Apr. 7, 2011

(51) Int. Cl.
*B24B 23/00* (2006.01)

(52) U.S. Cl. ..... 451/11; 451/359

(58) Field of Classification Search ..... 451/359, 451/344, 358, 11, 5, 8
See application file for complete search history.

(56) References Cited

U.S. PATENT DOCUMENTS 7,318,768 B2 * 1/2008 Deshpande et al. ..... 451/5

* cited by examiner

*Primary Examiner* — Robert Rose
(74) *Attorney, Agent, or Firm* — Bacon&Thomas, PLLC

(57) ABSTRACT

The present invention relates to an internal rotation type direct motor-drive portable angle grinder. By means of the direct drive, the present invention prevents the emission of noise made by angle type transmission devices; and/or an inertial body is installed on the motor rotating part to form a flywheel to improve the grinding, polishing and machining or cutting abilities of the grinding wheel; and/or a motor is established to be open or semi-hermetic for the space from the interior to a housing and/or a handle of the motor to improve the effect of heat dissipation outward.

8 Claims, 1 Drawing Sheet

INTERNAL ROTATION TYPE DIRECT MOTOR-DRIVE PORTABLE ANGLE GRINDER

BACKGROUND OF THE INVENTION (a) Field of the Invention

The present invention relates to an internal rotation type direct motor-drive portable angle grinder with an internal rotation type motor rotating part coaxially and directly driving a grinding wheel. By means of the direct drive, the present invention prevents the emission of noise made by angle type transmission devices; and/or an inertial body is installed on the motor rotating part to form a flywheel to improve the grinding, polishing and machining or cutting abilities of the grinding wheel; and/or a motor is established to be open or semi-hermetic for the space from the interior to a housing and/or a handle of the motor to improve the effect of heat dissipation outward. Aside from a manually controlled electromechanical device, a power storing and discharging device is also installed in the handle for use as a power source.

(b) Description of the Prior Art

Traditional motor-drive right-angle type portable grinder is an electrical tool designed according to ergonomics. Its structural features are the following:

1. The angular difference between the handle axis extending from the housing and the grinding wheel axis is between 30° and 150°;
2. The electric motor is installed in the handle; and
3. An angle type transmission device such as a bevel gear set is present in between the grinding wheel spindle and the motor spindle installed in the handle;

Because the above structure necessitates an angle type transmission device, the resulting very loud noise is the deficiency.

SUMMARY OF THE INVENTION

The present invention relates to an internal rotation type direct motor-drive portable angle grinder with an internal rotation type motor rotating part coaxially and directly driving a grinding wheel. By means of the direct drive, the present invention prevents the emission of noise made by angle type transmission devices; and/or an inertial body is installed on the motor rotating part to form a flywheel to improve the grinding, polishing and machining or cutting abilities of the grinding wheel; and/or a motor is established to be open or semi-hermetic for the space from the interior to a housing and/or a handle of the motor to improve the effect of heat dissipation outward. Aside from a manually controlled electromechanical device, a power storing and discharging device is also installed in the handle for use as a power source.

Figure 1:
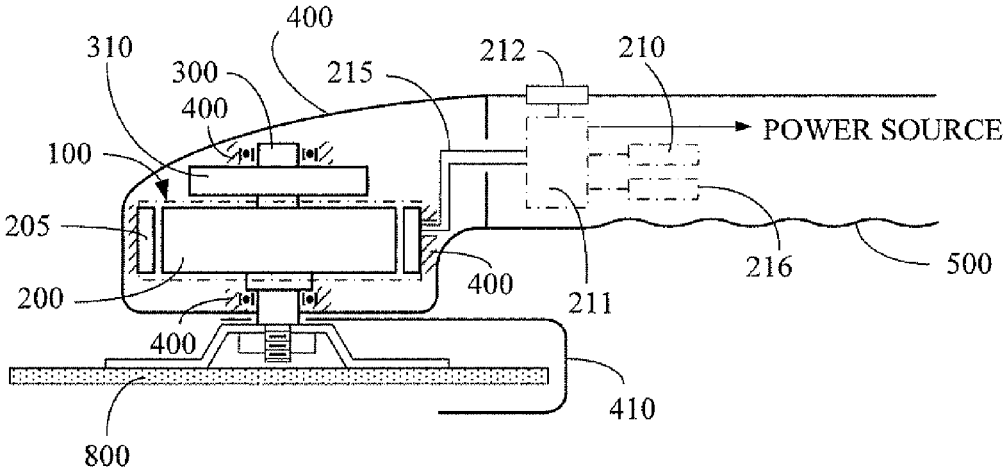
FIG. 1 is a structural drawing showing the main components of the internal rotation type direct motor-drive portable angle grinder of the present invention.

DESCRIPTION OF MAIN COMPONENT SYMBOLS (100): Electric motor
(200): Motor rotating part (205): Motor static part
(210): Power storing and discharging device
(211): Motor control circuit device
(212): Manually operated electromechanical device
(215): Power cord
(216): Charging control circuit device
(250): Vent
(300): Motor spindle
(310): Inertial body
(400): Housing
(410): Guard
(500): Handle
(800): Grinding wheel

DETAILED DESCRIPTION OF THE PREFERRED EMBODIMENTS

The present invention relates to an internal rotation type direct motor-drive portable angle grinder with an internal rotation type motor rotating part coaxially and directly driving a grinding wheel. By means of the direct drive, the present invention prevents the emission of noise made by angle type transmission devices; and/or an inertial body is installed on the motor rotating part to form a flywheel to improve the grinding, polishing and machining or cutting abilities of the grinding wheel; and/or a motor is established to be open or semi-hermetic for the space from the interior to a housing and/or a handle of the motor to improve the effect of heat dissipation outward. Aside from a manually controlled electromechanical device, a power storing and discharging device is also installed in the handle for use as a power source.

FIG. 1 is a structural drawing showing the main components of the internal rotation type direct motor-drive portable angle grinder. The structural pattern of the internal rotation type direct motor-drive portable angle grinder as shown in FIG. 1 is formed by the coaxial drive of the internal rotation type rotating part of the drive motor on the grinding wheel. The main components include:

Electric motor (100): consisted of alternating or direct current, brush or brushless, synchronous or asynchronous internal rotation type electric motor, including a motor static part (205) and an internal rotation type motor rotating part (200), which are cylindrical, conical or disc type, wherein the motor static part (205) of the electric motor (100) is installed within a hermetic housing (400), the deflection angle between the axis of a spindle (300) of the motor rotating part (200) of the electric motor (100) and the axis of a handle (500) is between 30° and 150°, and/or a inertial body (310) is installed on the motor rotating part (200) and/or the motor spindle (300) to make high speed and high inertial rotary drive to facilitate the operations of grinding, polishing or cutting workpieces by a grinding wheel (800) or a circular saw, and the grinding wheel (800) is coaxially installed with the spindle (300) of the motor rotating part (200);

Housing (400): related to a structure formed by solid state material for the installation of the electric motor (100) and the handle (500) formed by an extended body or assembly, wherein the motor static part (205) of the electric motor (100) is installed within the hermetic housing (400); and the deflection angle between the axis of the spindle (300) of the rotating part (200) of the drive motor (100) and the axis of the handle (500) is between 30° and 150°;

Handle (500): related to a hollow body for the installation of one or more of the following circuit devices including power cord (215), manually operated electromechanical device (212), and optional devices like power storing and discharging device (210), and/or charging control circuit device (216), and/or motor control circuit device (211), and/or an indicator lamp, and/or power display device for the operational control of the motor parallel transmission portable angle grinder;

Manually operated electromechanical device (212): related to an interface that directly or by way of the control circuit (211) provides the operator with the control over the direct motor-drive portable angle grinder, and is formed by electromechanical or solid state electronic structure for turning the motor on or off, and/or changing the rotational speed and/or varying the speed;

Power storing and discharging device (210): consisted of rechargeable and dischargeable batteries or ultracapacitors, and is configured as need;

Motor control circuit device (211): related to a circuit device formed by electromechanical and/or solid state electronic circuit device and configured as need for the execution of turning the motor on and off, and/or changing the rotational speed and/or varying the speed, and/or for the control and protection of voltage and current;

Charging control circuit device (216): related to a circuit device formed by electromechanical and/or solid state electronic circuit device and configured as need for controlling the external power supply over charging power supply, current and power-down timing for the power storing and discharging device (210);

Grinding wheel (800): installed on the spindle (300) of the motor rotating part (200) to provide rotary drive operation for grinding, polishing and cutting workpieces; and Guard (410): installed on one side of the grinding wheel (800) and the rotating part (200) adjacent to the handle.

The characterized in that is the motor established to be open or semi-hermetic for the space from the interior to the housing and/or the handle of the motor to improve the effect of heat dissipation outward, and/or the inertial body (310) installed on the motor rotating part (200) and/or the motor spindle (300) to make high speed and high inertial rotary drive to facilitate the grinding, polishing or cutting operations of the grinding wheel (800) or a circular saw.

The internal rotation type direct motor-drive portable angle grinder can also be a composite structure, in which the internal rotation type electric motor (100) and the housing (400) separates with each other.

Figure 2:
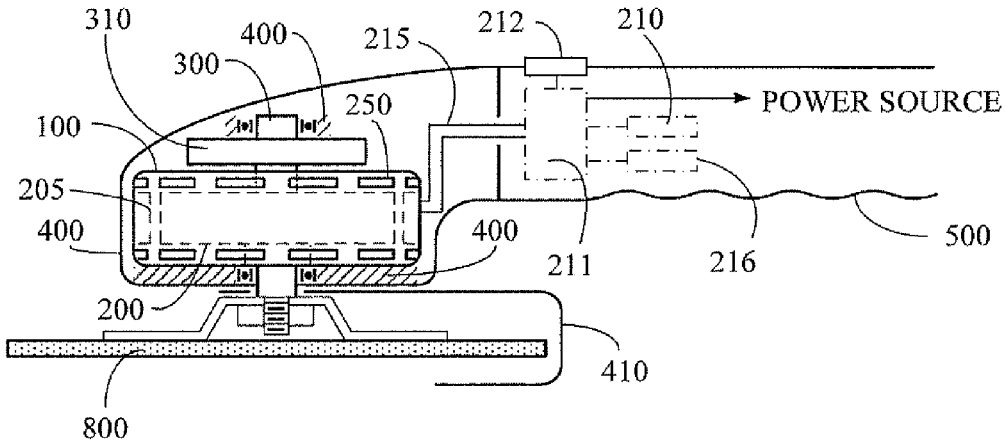
FIG. 2 is a structural drawing showing an embodiment, wherein the internal rotation type motor and the housing separates with each other, according to the present invention.

FIG. 2 is a structural drawing showing an embodiment, wherein the internal rotation type motor and the housing separates with each other, according to the present invention.

FIG. 2 shows an embodiment of a composite structure, wherein the internal rotation type motor and the housing separates with each other, according to the present invention. The main components include:

Electric motor (100): consisted of alternating or direct current, brush or brushless, synchronous or asynchronous internal rotation type electric motor, which is hermetic, open or semi-hermetic type, including a motor static part (205) and a motor rotating part (200), which are cylindrical, conical or disc type and hermetic, open or semi-hermetic type, wherein the electric motor (100) is installed within a hermetic housing (400) to facilitate the motor heat dissipation outward through the housing (400), and/or a inertial body (310) is installed on the motor rotating part (200) and/or the motor spindle (300) to make high speed and high inertial rotary drive to facilitate the grinding, polishing or cutting operations of a grinding wheel (800) or a circular saw, and the grinding wheel (800) is coaxially installed with the spindle (300) of the motor rotating part (200);

Housing (400): related to a hermetic structure formed by solid state material for the installation of the hermetic, semi-hermetic or open type electric motor (100) and the handle (500) formed by an extended body or assembly, wherein the electric motor (100) is installed within the hermetic housing (400); and the deflection angle between the axis of the spindle (300) of the rotating part (200) of the drive motor (100) and the axis of the handle (500) is between 30° and 150°;

Handle (500): related to a hollow body for the installation of one or more of the following circuit devices including power cord (215), manually operated electromechanical device (212), and optional devices like power storing and discharging device (210), and/or charging control circuit device (216), and/or motor control circuit device (211), and/or an indicator lamp, and/or power display device for the operational control of the motor parallel transmission portable angle grinder;

Manually operated electromechanical device (212): related to an interface that directly or by way of the control circuit (211) provides the operator with the control over the direct motor-drive portable angle grinder, and is formed by electromechanical or solid state electronic structure for turning the motor on or off, and/or changing the rotational speed and/or varying the speed;

Power storing and discharging device (210): consisted of rechargeable and dischargeable batteries or ultracapacitors, and is configured as need;

Motor control circuit device (211): related to a circuit device formed by electromechanical and/or solid state electronic circuit device and configured as need for the execution of turning the motor on and off, and/or changing the rotational speed and/or varying the speed, and/or for the control and protection of voltage and current;

Charging control circuit device (216): related to a circuit device formed by electromechanical and/or solid state electronic circuit device and configured as need for controlling the external power supply over charging power supply, current and power-down timing for the power storing and discharging device (210);

Grinding wheel (800): installed on the spindle (300) of the motor rotating part (200) to provide rotary drive operation for grinding, polishing and cutting workpieces; and Guard (410): installed on one side of the grinding wheel (800) and the rotating part (200) adjacent to the handle.

The characterized in that is the motor established to be open or semi-hermetic for the space from the interior to the housing and/or the handle of the motor to improve the effect of heat dissipation outward through the housing (400), and/or the inertial body (310) installed on the motor rotating part (200) and/or the motor spindle (300) to make high speed and high inertial rotary drive to facilitate the grinding, polishing or cutting operations of the grinding wheel (800) or a circular saw.

What is claimed is:

1. A direct motor-drive portable angle grinder, comprising:

a handle (500);

an electric motor (100) including a stator (205) and an internal rotor (200) mounted to rotate with a spindle (300), wherein a deflection angle between an axis of the spindle and an axis of a handle (500) is between 30° and 150°, and an inertial body (310) is installed on the rotor (200) or the spindle (300) provide a high speed, high inertia drive for facilitating grinding, polishing, or cutting operations by a grinding wheel (800) or circular saw coaxially installed with the spindle or the rotor;

a housing (400) within which the motor stator is installed and from which the handle extends;

a manually operated electromechanical device (212) for providing at least one of the manual control functions: manually turning the motor on and off and changing a speed of the motor; and a guard (410) installed adjacent the handle on one side of the rotor (200) and the grinding wheel or circular saw wherein the housing (400) is at least partially open to provide an outward heat dissipation.

2. A direct motor-drive portable angle grinder as claimed in claim 1, wherein the electric motor (100), wherein the handle is a hollow body for installation of at least one of a power cord (215) and said manually operated electromechanical device (212).

3. A direct motor-drive portable angle grinder as claimed in claim 1, wherein the stator (205) is integrated with the housing (400).

4. A direct motor-drive portable angle grinder as claimed in claim 1, wherein the electric motor (100) and the housing (400) are separate from each other.

5. A direct motor-drive portable angle grinder as claimed in claim 1, wherein the manually operated electromechanical input device (212) turns said motor on and off and changes a speed of the motor through a control circuit (211).

6. A direct motor-drive portable angle grinder as claimed in claim 5, wherein said control circuit (211) provides and current/voltage protection and controls the speed of the motor by varying a motor voltage and current.

7. A direct motor-drive portable angle grinder as claimed in claim 1, further comprising a power storing and discharging device (210) made up of rechargeable and dischargeable batteries or ultracapacitors.

8. A direct motor-drive portable angle grinder as claimed in claim 7, further comprising a charging control circuit device (216) for controlling an external power supply for charging the power storing and discharging device (210).

* * * * *